US012004695B1

(12) United States Patent
Watson

(10) Patent No.: US 12,004,695 B1
(45) **Date of Patent: *Jun. 11, 2024**

(54) MULTI-COMPARTMENT WALK-IN BATHTUB

(71) Applicant: James Robert Watson, Frenchtown, NJ (US)

(72) Inventor: James Robert Watson, Frenchtown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/178,204

(22) Filed: Mar. 3, 2023

Related U.S. Application Data

(63) Continuation of application No. 17/648,586, filed on Jan. 21, 2022, now Pat. No. 11,596,268.

(60) Provisional application No. 63/158,148, filed on Mar. 8, 2021.

(51) Int. Cl.
*A47K 3/00* (2006.01)

(52) U.S. Cl.
CPC ..... *A47K 3/006* (2013.01)

(58) Field of Classification Search
CPC ..... A47K 3/006
USPC ..... 4/555–557, 639, 564.1, 565.1
See application file for complete search history.

(56) References Cited

U.S. PATENT DOCUMENTS

| | | | | |
|---|---|---|---|---|
| 6,226,808 | B1 * | 5/2001 | Walshe | A47K 3/006 4/557 |
| 11,596,268 | B2 * | 3/2023 | Watson | A47K 3/006 |
| 2003/0172452 | A1 * | 9/2003 | Wihlborg | G01N 15/1475 4/565.1 |
| 2010/0325789 | A1 * | 12/2010 | Ouyoung | A47K 3/006 4/555 |

FOREIGN PATENT DOCUMENTS

| | | | | |
|---|---|---|---|---|
| WO | WO-0195776 | A1 * | 12/2001 | A47K 3/006 |

* cited by examiner

*Primary Examiner* — Tuan N Nguyen
(74) *Attorney, Agent, or Firm* — Squire Patent Consulting & IP Law LLC; Brendan E. Squire

(57) ABSTRACT

A multi-compartment walk-in bathtub is disclosed that allows for a first compartment of the walk-in bathtub to be filled with a quantity of water while a second compartment of the walk-in bathtub allows the user to enter the bathtub. A first movable gate contains a volume of water in the first compartment while the second compartment is in an unfilled condition. A second movable gate is operable to open and close an entry sidewall of the bathtub, allowing the user to enter the second compartment. The second movable gate is then moved to a closed position. When the second movable gate is in the closed condition, the first movable gate may be moved to an open condition to release the volume of water and fill the walk-in bathtub to a filled condition. A seat may be provided that is selectively elevated and lowered by drive mechanism.

20 Claims, 4 Drawing Sheets

MULTI-COMPARTMENT WALK-IN BATHTUB

CROSS-REFERENCE TO RELATED APPLICATION

This application is a continuation of U.S. patent application Ser. No. 17/648,586, filed Jan. 21, 2022, and claims the benefit of priority of U.S. provisional application No. 63/158,148, filed Mar. 8, 2021, the contents of which are herein incorporated by reference.

BACKGROUND OF THE INVENTION

The present invention relates to bathtubs, and more particularly to walk-in bathtubs.

Walk-in bathtubs feature a door or an access panel in a sidewall of the tub to allow the user to step into the bathtub without the need to step over the sidewall of the tub. Unlike a conventional bathtub, in walk-in bathtubs, the user must wait until the bathtub fills while the user either sits or stands within the closed bathtub enclosure. This delay can range from a simple inconvenience to ambulatory users and can present significant difficulties for caregivers for non-ambulatory or a non-compliant patient.

As can be seen, there is a need for a multi-compartment walk-in bathtub that solves these and other problems.

SUMMARY OF THE INVENTION

In one aspect of the present invention, a multi-compartment walk-in tub is disclosed. The multi-compartment walk-in tub includes an outer shell having at least one sidewall. The outer shell contains a first compartment and a second compartment. A first movable gate is carried within a first track and is operable to selectively separate the first compartment from the second compartment to contain a volume of water within the first compartment. A second movable gate is carried within a second track to selectively open and close an access way to the second compartment through the at least one sidewall/The first movable gate and the second movable gate are independently operable between their respective open and closed positions.

In some embodiments, the first movable gate is operable to an open position to release the volume of water into the second compartment when the second movable gate is positioned to close the access way.

In some embodiments, a seal is provided within each of the first track and the second track. The seal engages with each of the first movable gate and the second movable gate to contain the volume of water.

In some embodiments a seat is mounted within the first compartment. A drive mechanism is configured to selectively elevate and lower the seat. The drive mechanism may include a motor, a drive screw operable by the motor; and a carrier interconnecting the seat with the drive screw.

In some embodiments, a first lock is operable to retain the first movable gate in a closed position. A second lock is operable to retain the second movable gate in the closed position.

In some embodiments, at least one drain is operable to release the volume of water from one or more of the first compartment and the second compartment.

In other embodiments, a shower door is movable to contain a water spray released from a shower head within the second compartment. The shower door is movably carried above the second track.

In other aspects of the invention, a multi-compartment walk-in tub is disclosed having an outer shell with at least one sidewall. The outer shell contains a first compartment and a second compartment. A first movable gate is operable within a first arcuate track to selectively separate the first compartment from the second compartment. A second movable gate is operable within a second arcuate track to selectively open and close an access way to the second compartment through the at least one sidewall. A shower door is independently operable from the second movable gate to selectively define a shower enclosure above the second compartment with the second movable gate closing the access way.

In some embodiments, the first movable gate is operable between an open position and a closed position, and in the closed position the first compartment is configured to contain a volume of water separate from the second compartment. In an open position first compartment is configured to release the volume of water into the second compartment.

In some embodiments, a seat is operable between an elevated position and a lowered position within the first compartment. A drive mechanism is carried within the outer shell to selectively position the seat between the elevated position and the lowered position. A seat bottom is hingedly connected with the seat. In the lowered position, the seat bottom is positioned at a bottom of the first compartment.

In other aspects of the invention, a multi-compartment walk-in tub is disclosed having an outer shell with at least one sidewall. The outer shell defines a first compartment and a second compartment, a first arcuate track, a second arcuate track, and a walk-in access way into the second compartment. A first movable gate is operable within the first arcuate track to selectively separate the first compartment from the second compartment. The first movable gate has a vertical height configured to contain a first volume of water within the first compartment. A second movable gate is operable within the second arcuate track. The second movable gate is configured to selectively open and close the walk-in access way into the second compartment. The second movable gate has a height less than the vertical height of the first movable gate.

In some embodiments, the first compartment and the second compartment are dimensioned to contain an equalized volume of water below the vertical height of the second movable gate when the first volume of water is released from the first compartment into the second compartment.

In some embodiments, a seat is operable between an elevated position and a lowered position within the first compartment. A drive mechanism is carried within the outer shell to selectively position the seat between the elevated position and the lowered position.

In some embodiments, a shower door, is independently operable from the second movable gate. The shower door is oriented to selectively define a shower enclosure above the second compartment with the second movable gate closing the walk-in access way. In a closed position, the shower door is oriented to deflect a water spray above the second movable gate into the second compartment.

These and other features, aspects and advantages of the present invention will become better understood with reference to the following drawings, description and claims.

DETAILED DESCRIPTION

Figure 1:
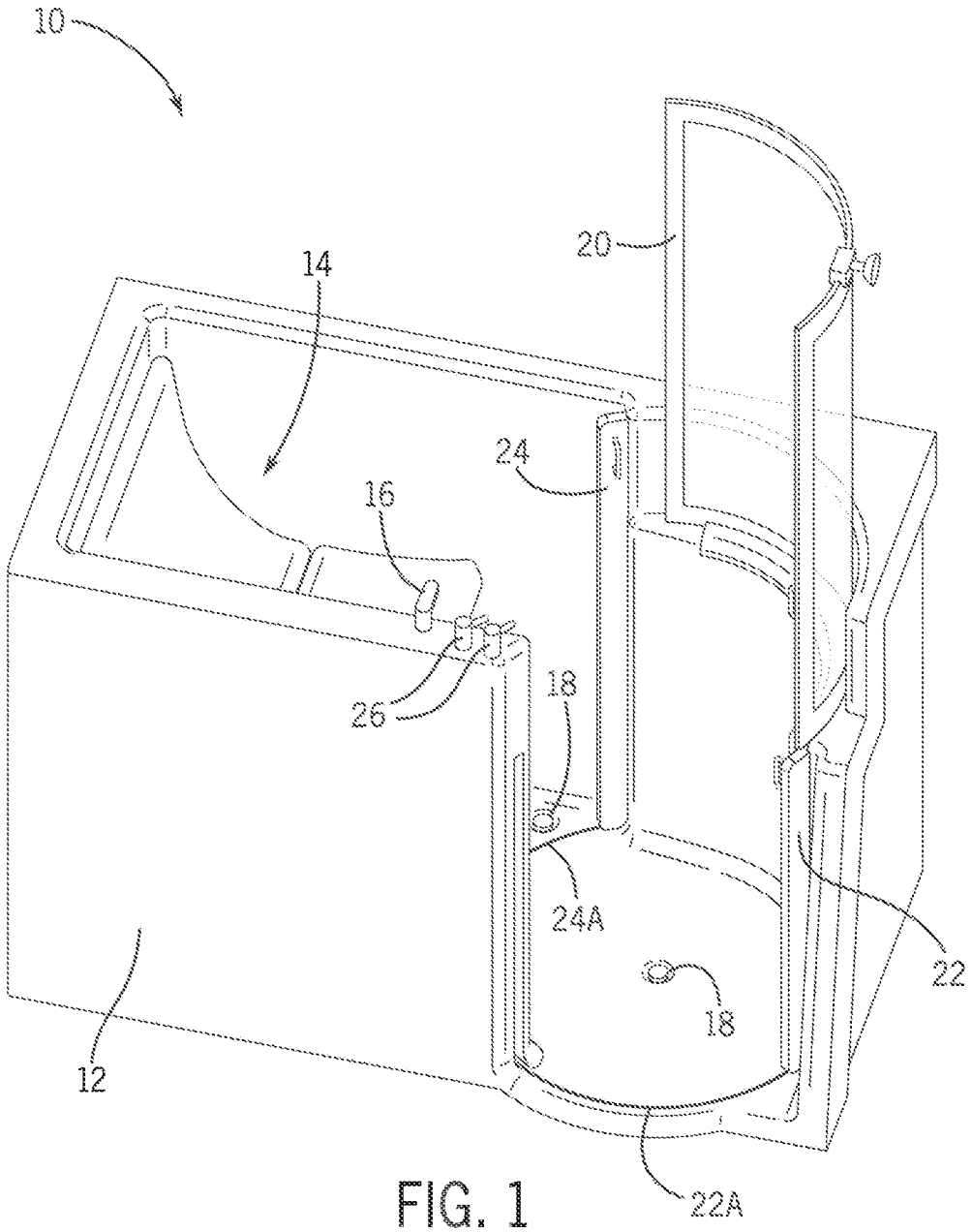
FIG. 1 is a front perspective view of the a multi-compartment walk-in bathtub shown in an open condition.
Figure 2:
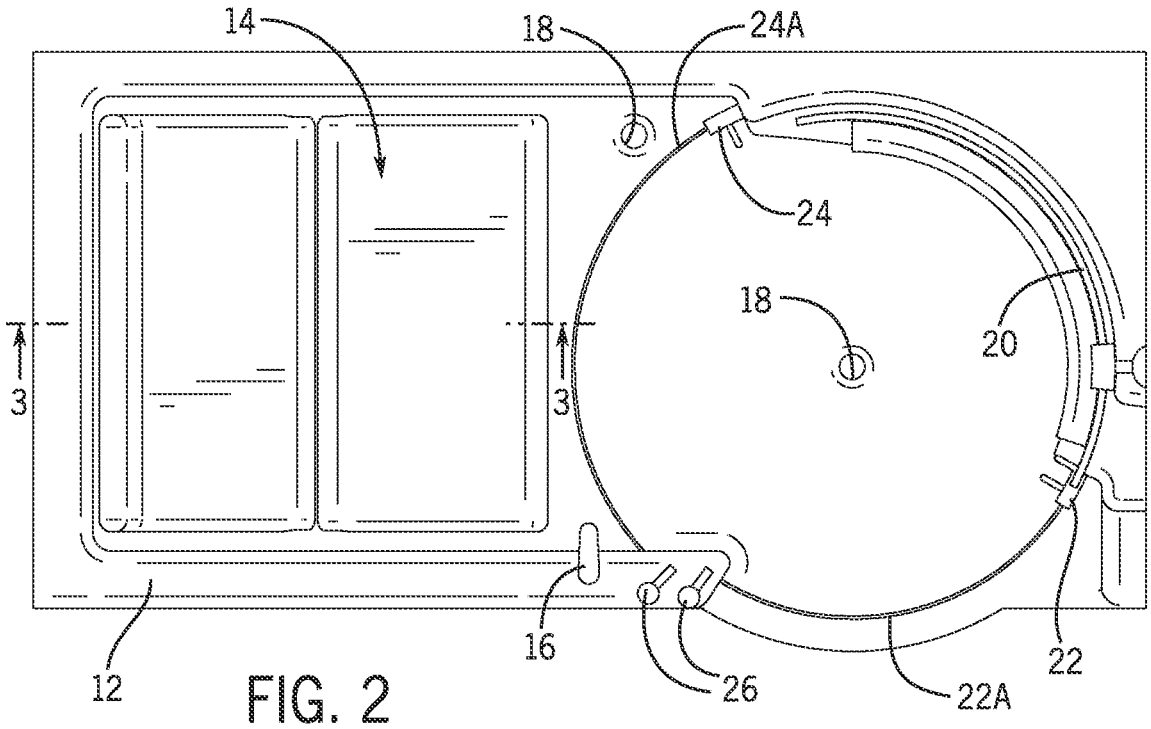
FIG. 2 is a top plan view of the a multi-compartment walk-in bathtub.

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide a multi-compartment walk-in bathtub that allows for a first compartment of the walk-in bathtub to be filled with a quantity of water while a second compartment of the walk-in bathtub allows the user to enter the bathtub. A first movable gate contains a volume of water in the first compartment while the second compartment is in an unfilled condition, allowing the user to enter the second compartment. A second movable gate is operable to open and close an entry sidewall of the bathtub, allowing the user to enter the second compartment. The second movable gate is then moved to a closed position. When the second movable gate is in the closed condition, the first movable gate may be moved to an open condition to release the volume of water and fill the multi-compartment walk-in bathtub to a filled condition.

As seen in reference to the drawings of FIGS. 1-7, the multi-compartment walk-in bathtub 10 includes an outer shell 12 having at least one sidewall. A first compartment may include a seat 14 for the user to utilize when taking a bath. The multi-compartment walk-in bathtub 10 includes a waterspout 16, or spigot, and one or more control valves (not shown) that are operable to control a flow and a temperature of a volume of water 30 to fill the walk-in bathtub 10. One or more drains 18 are provided to drain the volume of water 30 from the walk-in bathtub 10.

The first movable gate 24 is provided to separate the first compartment and the second compartment of the walk-in tub 10 during a filling of the first compartment. With the first movable gate 24 positioned in the closed position, the first compartment may be filled to a desired volume of water 30. In the non-limiting embodiment shown, the first movable gate 24 has an arcuate shape and is carried within an arcuate track within the sidewall of the second compartment. The first movable gate 24 may be carried in a track 24A separating the first compartment from the second compartment. A seal (not shown) is provided about a lower peripheral and a side edge of the first movable gate 24 to contain the volume of water in the first compartment.

In the non-limiting embodiment shown, the second compartment may be substantially cylindrical in shape. The second compartment includes a second movable gate 22 defined in the at least one sidewall. The second movable gate 22 is carried and operable in a second gate track 22A between an open condition and a closed condition. In the open condition, the user may step through an access way through the at least one sidewall. In the closed condition, the second gate 22 closes the access way to contain the volume of water 30 within the second compartment.

A lock 26 is provided for securing each of the first movable gate 24 and the second movable gate 22 to secure the first movable gate 24 and the second movable gate 22 in the closed, water containing position.

Figure 3:
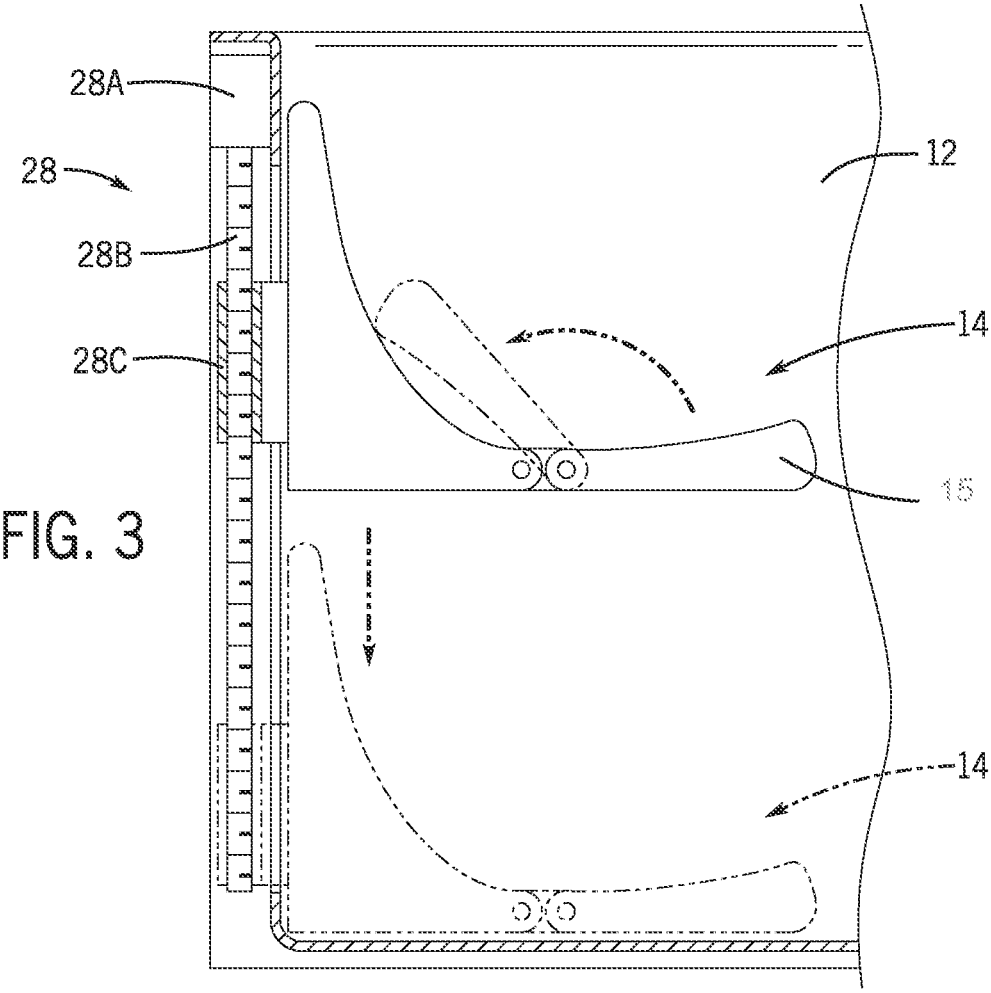
FIG. 3 is a cross-sectional view taken on line 3-3 of FIG. 2.
Figure 5:
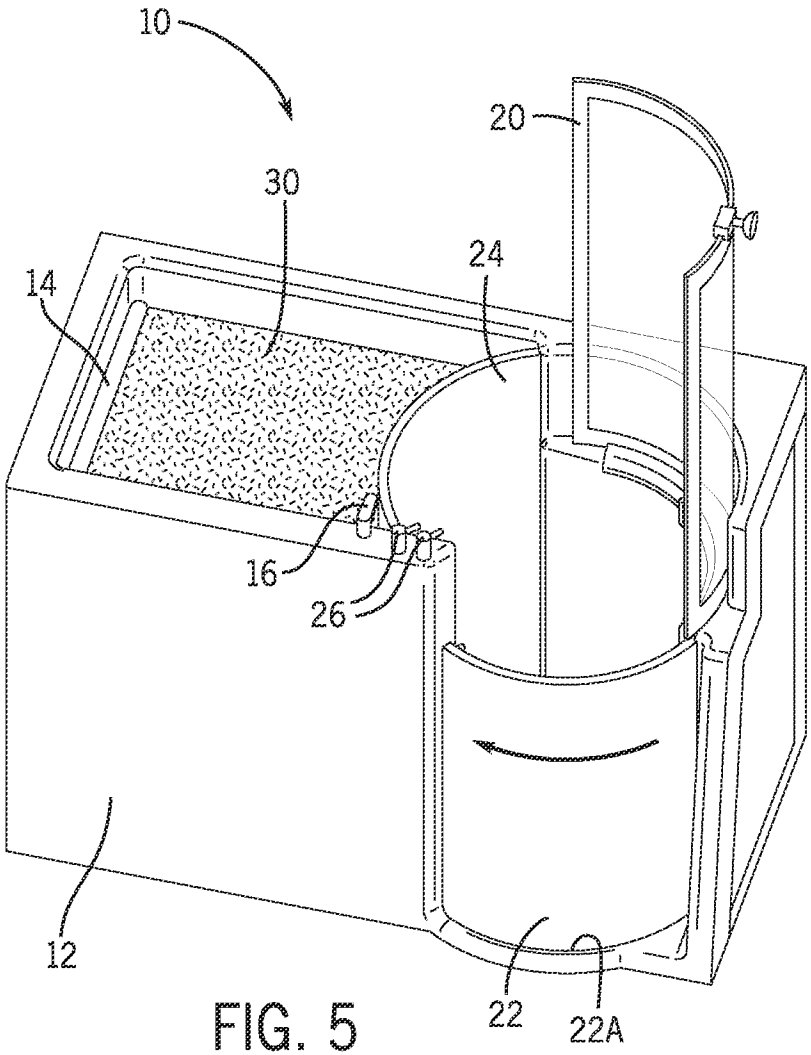
FIG. 5 is a front perspective view, similar to FIG. 1, showing the a multi-compartment walk-in bathtub in a second stage of use.
Figure 4:
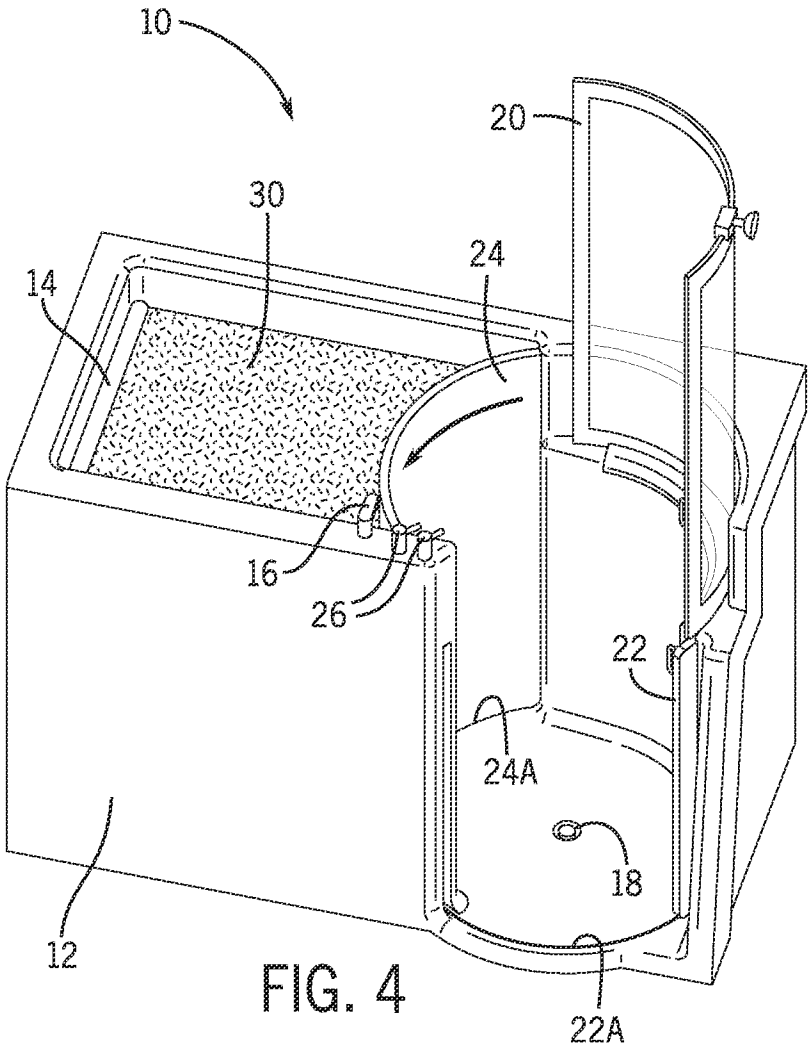
FIG. 4 is a front perspective view, similar to FIG. 1, showing the a multi-compartment walk-in bathtub in a first stage of use.
Figure 7:
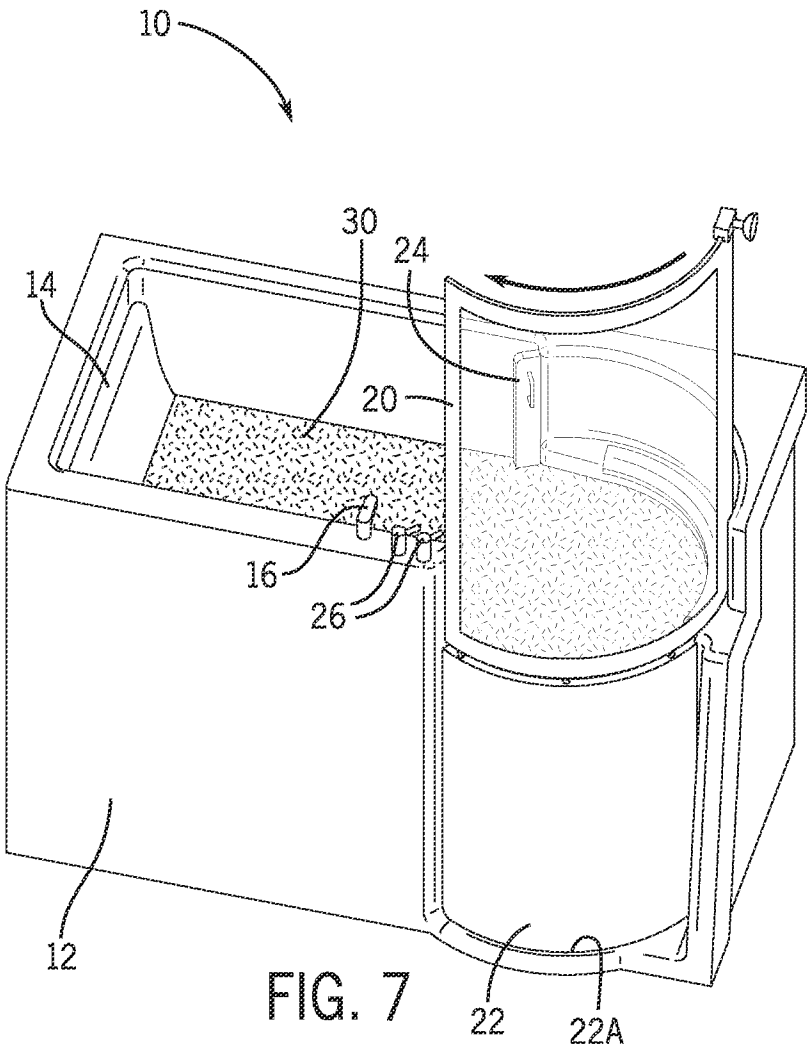
FIG. 7 is a front perspective view, similar to FIG. 1, showing the a multi-compartment walk-in bathtub in a fourth stage of use.
Figure 6:
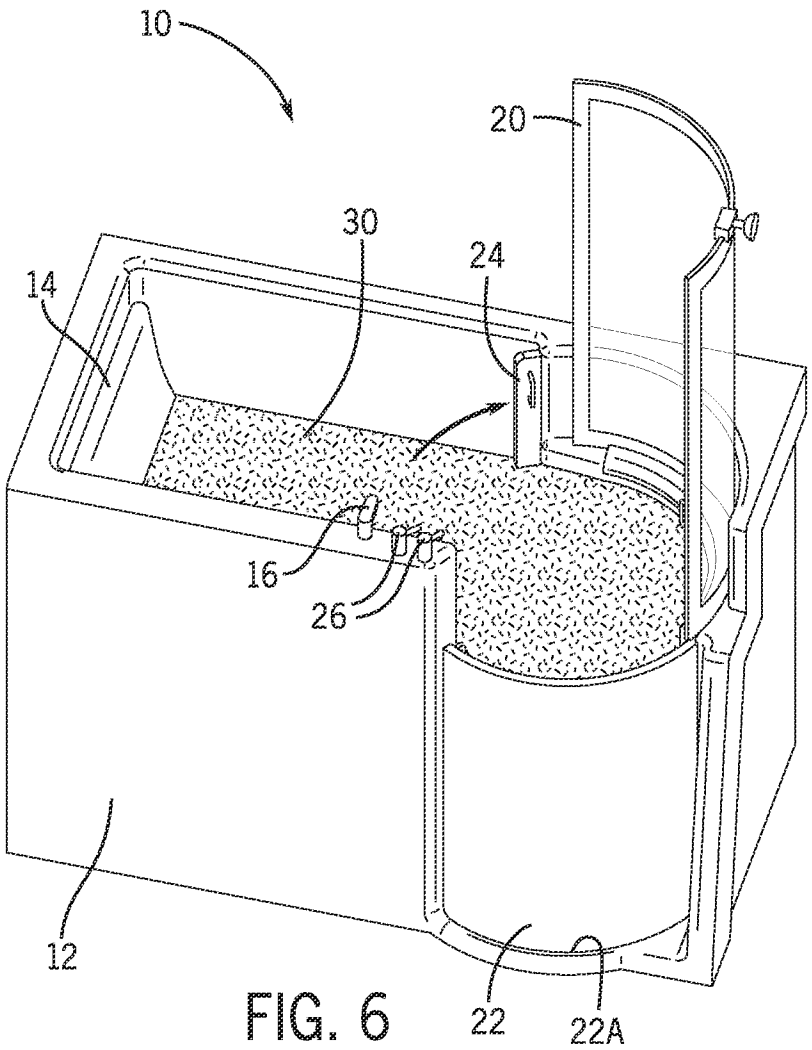
FIG. 6 is a front perspective view, similar to FIG. 1, showing the a multi-compartment walk-in bathtub in a third stage of use.

As seen in reference to FIG. 3, a drive mechanism 28 is provided to selectively elevate and lower the seat within the first compartment. The drive mechanism 28 may include a motor 28A operable to turn a drive screw 26B. A back rest of the seat 14 includes a carrier 28C for cooperative engagement with the drive screw 26B such that the seat is raised or lowered by a rotation of the drive screw 26B. The seat 14 may include a tilting base 15 portion that prevents splashing or displacement of the volume of water 30 carried in the first compartment when the seat 14 is raised or lowered within the volume of water 30. In other embodiments, the drive mechanism may include a scissors type lift, a cantilevered beam, or a hoist arrangement as may be needed for different user conditions.

The second compartment may be configured as a shower in which a shower door 20 is movable atop the second movable gate 22 to contain water released from a shower head within the second compartment and/or the first compartment.

In operation, the first gate 24 is secured in the closed condition and is secured by the corresponding lock 26. The first compartment may then be filled with a desired volume and temperature of water 30. When the user is ready to take their bath, the user enters through the access way and secures the second gate 22 in the closed position with its associated lock 26. Once the second gate 22 is secured, the user may then open the first gate 24, releasing the volume of water 30 contained within the first compartment to quickly fill the second compartment. The user may then complete their bath. The user may elevate the seat 14 to a desired elevation and then selectively lower the seat 14 to a desired elevation.

As will be appreciated, the first compartment will preferably have a significantly larger containment volume than the second compartment, such that the volume of water 30 contained within the first compartment provides a suitable volume of water 30 for bathing in the walk-in bathtub 10 when the volume of water 30 has equalized between the first compartment and the second compartment.

When the user has completed their bath, they may then open the one or more drains 18. Once the volume of water 30 has drained from the first compartment and the second compartment, the user may actuate the lock 26 securing the second gate 22 and depart the walk-in tub 10 through the access way.

It should be understood, of course, that the foregoing relates to exemplary embodiments of the invention and that modifications may be made without departing from the spirit and scope of the invention as set forth in the following claims.

What is claimed is:

1. A multi-compartment walk-in tub, comprising:

an outer shell having at least one sidewall, the outer shell containing a first compartment and a second compartment, an arcuate first movable gate carried within a first track defined in an arcuate interior sidewall of the second compartment, the arcuate first movable gate operable to selectively separate the first compartment from the second compartment to contain a volume of water within the first compartment; and a second movable gate carried within a second track defined in the second compartment and spaced apart from the first track, the second movable gate operable to selectively open and close an access way to the second compartment through the at least one sidewall, the first movable gate and the second movable gate independently operable between their respective open and closed positions.

2. The multi-compartment walk-in tub of claim 1, wherein the first movable gate is operable to an open position to release the volume of water into the second compartment when the second movable gate is positioned to close the access way.

3. The multi-compartment walk-in tub of claim 1, further comprising:

a seal within each of the first track and the second track, the seal engaging with each of the first movable gate and the second movable gate to contain the volume of water.

4. The multi-compartment walk-in tub of claim 1, further comprising:

a seat mounted within the first compartment; and a drive mechanism configured to selectively elevate and lower the seat.

5. The multi-compartment walk-in tub of claim 4, the drive mechanism further comprising:

a motor, a drive screw operable by the motor; and a carrier interconnecting the seat with the drive screw.

6. The multi-compartment walk-in tub of claim 1, further comprising:

a first lock operable to retain the first movable gate in a closed position; and a second lock operable to retain the second movable gate in the closed position.

7. The multi-compartment walk-in tub of claim 1, further comprising:

at least one drain operable to release the volume of water from one or more of the first compartment and the second compartment.

8. The multi-compartment walk-in tub of claim 1, further comprising:

a shower door movable to contain a water spray released from a shower head within the second compartment.

9. The multi-compartment walk-in tub of claim 8, wherein the shower door is movably carried above the second track.

10. A multi-compartment walk-in tub, comprising:

an outer shell having at least one sidewall, the outer shell containing a first compartment and a second compartment, a first movable gate rotationally operable within a first arcuate track to selectively separate the first compartment from the second compartment;

a second movable gate rotationally operable within a second arcuate track to selectively open and close an access way to the second compartment through the at least one sidewall, the first and second arcuate tracks defined adjacent each other within the at least one sidewall, such that the first movable gate and the second movable gate overlap each other when each is moved to an open condition; and a shower door independently operable from the second movable gate, to selectively define a shower enclosure above the second compartment with the second movable gate closing the access way.

11. The multi-compartment walk-in tub of claim 10, wherein the first movable gate is operable between an open position and a closed position, and in the closed position the first compartment is configured to contain a volume of water separate from the second compartment.

12. The multi-compartment walk-in tub of claim 11, wherein in an open position first compartment is configured to release the volume of water into the second compartment.

13. The multi-compartment walk-in tub of claim 10, further comprising:

a seat operable between an elevated position and a lowered position within the first compartment; and a drive mechanism carried within the outer shell to selectively position the seat between the elevated position and the lowered position.

14. The multi-compartment walk-in tub of claim 13 further comprising:

a seat bottom hingedly connected with the seat.

15. The multi-compartment walk-in tub of claim 14, wherein in the lowered position, the seat bottom is positioned at a bottom of the first compartment.

16. A multi-compartment walk-in tub, comprising:

an outer shell having at least one sidewall, the outer shell defining a first compartment and a second compartment, a first arcuate track, and a second arcuate track, and a walk-in access way into the second compartment;

a first movable gate operable within the first arcuate track to selectively separate the first compartment from the second compartment, the first movable gate having a vertical height configured to contain a first volume of water within the first compartment; and a second movable gate operable within the second arcuate track radially offset and adjacent with the first arcuate track, the second movable gate configured to selectively open and close the walk-in access way into the second compartment, the second movable gate having a height less than the vertical height of the first movable gate, such that the second movable gate contains the first volume of water, when equalized between the first compartment and the second compartment.

17. The multi-compartment walk-in tub of claim 16, wherein the first compartment and the second compartment are dimensioned to contain an equalized volume of water below the vertical height of the second movable gate when the first volume of water is released from the first compartment into the second compartment.

18. The multi-compartment walk-in tub of claim 16, further comprising:

a seat operable between an elevated position and a lowered position within the first compartment; and a drive mechanism carried within the outer shell to selectively position the seat between the elevated position and the lowered position.

19. The multi-compartment walk-in tub of claim 16, further comprising:

a shower door, independently operable from the second movable gate, the shower door oriented to selectively define a shower enclosure above the second compartment with the second movable gate closing the walk-in access way.

20. The multi-compartment walk-in tub of claim 19, wherein in a closed position, the shower door is oriented to deflect a water spray above the second movable gate into the second compartment.

* * * * *